US006470606B1

(12) United States Patent
Nagahiro et al.

(10) Patent No.: US 6,470,606 B1
(45) Date of Patent: Oct. 29, 2002

(54) VEHICLE HAVING APPARATUS FOR MONITORING FORWARD PORTION OF BLADE AND METHOD OF MONITORING FORWARD PORTION OF BLADE

(75) Inventors: Yuuichi Nagahiro, Katano; Toshio Yokoyama, Uji, both of (JP)

(73) Assignee: Komatsu Ltd., Tokyo (JP)

( * ) Notice: Subject to any disclaimer, the term of this patent is extended or adjusted under 35 U.S.C. 154(b) by 14 days.

(21) Appl. No.: 09/708,385

(22) Filed: Nov. 8, 2000

(30) Foreign Application Priority Data

Nov. 19, 1999 (JP) ..... 11-329588

(51) Int. Cl.[7] ..... E02F 1/00
(52) U.S. Cl. ..... 37/348
(58) Field of Search ..... 37/348, 382, 466; 172/5

(56) References Cited

U.S. PATENT DOCUMENTS 4,633,383 A * 12/1986 Omachi et al. ..... 364/167
4,776,750 A * 10/1988 Griswold, Jr. et al. ..... 414/698
5,141,384 A * 8/1992 Hvolka ..... 414/493
5,147,011 A * 9/1992 Hvolka ..... 180/234
5,438,771 A * 8/1995 Sahm et al. ..... 37/348
5,451,135 A * 9/1995 Schempf et al. ..... 414/674
5,481,257 A * 1/1996 Brubaker et al. ..... 340/825.69
5,524,368 A * 6/1996 Struck et al. ..... 37/235
5,530,330 A * 6/1996 Baiden et al. ..... 318/580
5,850,254 A * 12/1998 Takano et al. ..... 348/148
6,151,065 A * 11/2000 Steed et al. ..... 348/148
6,247,538 B1 * 6/2001 Takeda et al. ..... 172/2

FOREIGN PATENT DOCUMENTS

JP 7-42201 1/1995
JP 9-209394 8/1997

* cited by examiner

*Primary Examiner*—Thomas B. Will
*Assistant Examiner*—Kristine M Markovich
(74) *Attorney, Agent, or Firm*—Frishauf, Holtz, Goodman & Chick, P.C.

(57) ABSTRACT

A vehicle such as bull-dozer provided with a blade comprises a vehicle body having an operation room and is provided with a forward portion monitoring apparatus such as television camera set for picking up an image of a forward portion of a blade, and a display device on which an image of the forward portion of the blade monitored by the forward monitoring apparatus is displayed and the displayed image is observed in an operation room of the vehicle.

2 Claims, 7 Drawing Sheets

VEHICLE HAVING APPARATUS FOR MONITORING FORWARD PORTION OF BLADE AND METHOD OF MONITORING FORWARD PORTION OF BLADE

BACKGROUND OF THE INVENTION

The present invention relates to a vehicle provided with an apparatus for monitoring a condition of sediment or the like existing on the front of a blade at a dozing working time by using the blade and also relates to a method of monitoring a forward side portion of the blade.

As a technique for recognizing an excavating or digging condition of a forward working machine of construction equipment, the prior art provides, for example, Japanese Patent Laid-open Publication No. HEI 7-42201, in which a plurality of light emitting elements are arranged to one of side plates of a bucket for the excavating working and a plurality of light receiving elements are also arranged on the other one of side plates thereof at portions corresponding to each other, respectively, and the light emitting elements and the light receiving elements are connected, through optical fibers, to a light emitting/receiving device disposed in an operation room or chamber of a vehicle so as to discriminate whether sediment such as soil enters the bucket or not by detecting a cutoff (interrupting) state of light signals. An alarm device is also disposed so as to generate an alarm when the bucket is substantially filled up with the soil.

The prior art also provides Japanese Patent Laid-open Publication No. HEI 9-209394, which discloses a technique such that, in consideration of force relation between a horizontal force component and a perpendicular force component generated through the pushing of the excavated soil against the blade, an amount of the sediment including soil, small rocks or the like on the front of the blade is analyzed by means of a computer and then calculated in accordance with the excavated condition. In this technique, the amount of the sediment is continuously calculated and as occasion demands, the vertical motion or the angle of the blade is controlled to be variable, so as not to cause crawlers of a vehicle to be shoe-slipped.

However, according to the prior art techniques mentioned above, although the filling-up condition of the excavated sediment in the bucket can be recognized or the amount of the sediment to be excavated by using the blade can be calculated, a technique is not disclosed for recognizing the excavating condition on the front of the forward working machine, such as the blade of a construction machine.

Moreover, generally, in the dozing working of a bull-dozer, it is difficult to recognize a scooping condition of the sediment on the front of the blade, and this working has been relayed on experience of an expert and it is difficult for a beginner to adjust an edge angle of the blade.

That is, the most significant problem is no observation or monitoring of the sediment scooping condition of the blade at an actual working during the excavating and ground leveling working of the blade of the bull-dozer.

SUMMARY OF THE INVENTION

An object of the present invention is to solve a problem of not observing the scooping state of an excavated sediment on the front of a blade of a vehicle and, therefore, to provide a vehicle having an apparatus for monitoring a forward side portion of a blade of the vehicle and a method of monitoring the forward side portion thereof, wherein, in a state wherein an operator sits in an operator seat in an operation room, an image of the forward side portion of a blade of a vehicle, such as a construction machine, i.e. bull-dozer, is picked up by a blade forward monitoring device disposed at a forward side portion of the vehicle and the picked up image is displayed on an image display device to thereby visually observe the scooping state of the sediment such as soil by the blade of the vehicle at the time excavating occurs.

More specifically, an object of the present invention is to provide a vehicle having an apparatus for monitoring a forward side portion of a blade of the vehicle and a method of monitoring the forward side portion thereof, wherein a forward monitoring device, for example, a television camera set, is disposed above a blade of a vehicle to be movable in perpendicular and horizontal directions through remote control in an operation room of the vehicle, and a picked up image of a cutting edge portion of a central portion, lateral side portions or corner portions of the blade during the excavating operation is displayed on an image display device disposed at the front portion in the operation room.

The above and other objects can be achieved according to the present invention by providing, in one aspect, a vehicle provided with a forward monitoring apparatus: comprising:

- a vehicle body having an operation room;
- a forward monitoring apparatus for monitoring a forward portion of a blade provided for the vehicle body; and
- a display means for displaying an image of the forward portion monitored by the forward monitoring apparatus.

A moving mechanism is further disposed so as to be operated in the operation room through a remote control to move the monitoring apparatus from a position for picking up an image of a forward central position of the blade to a position for picking up an image of a forward lateral side position and/or a position for picking up an image of a forward vertical side position, and the display means on which the picked up image is displayed is disposed in the operation room.

There are further disposed a lift cylinder provided for the vehicle body for moving the blade, a position detection means for detecting a position of the blade moved by the lift cylinder and generating a position signal and a control means for calculating an excavating position by a cutting edge of the blade in response to the position signal from the position detection means and generating a command signal to the moving mechanism in accordance with a result of the calculation so as to direct the forward monitoring apparatus to a position for picking up the image of the excavating position.

The monitoring apparatus is a television camera set provided with a zoom mechanism which is operated remotely in the operation room.

According to the above one aspect of the present invention, the condition of sediment or the like scooped on the front of the blade of a vehicle such as bull-dozer can be monitored in the sediment or soil excavating work or ground leveling work, thus improving the workability of the vehicle and ensuring the safe and effective working condition.

Furthermore, by locating the moving mechanism for the forward portion monitoring apparatus, the operator can observe the scooping condition of the blade at the lateral side portion thereof and can easily operate the blade while observing the scooped condition and the lateral balance condition of the sediment.

Still furthermore, the arrangement of the control system operated remotely in the operation room allows the operator to easily monitor and control the movement of the blade.

The above operation can be further facilitated by using, as the monitoring apparatus, a television camera set provided with a zoom mechanism.

In another aspect of the present invention, there is also provided a method of monitoring a forward portion of a blade of a vehicle comprising the steps of:

preparing a forward monitoring apparatus to be mounted to a vehicle body and preparing a display means in an operation room of the vehicle;

picking up an image of the forward portion of the blade by the forward monitoring apparatus; and displaying an image of the forward portion on the display means so that an excavating working is carried out while monitoring the forward portion of the blade.

According to this blade forward portion monitoring method, the blade forward condition can be easily monitored by the operator in the operation room to thereby facilitate the working of the blade.

The nature and further characteristic features of the present invention will be made further clear from the following descriptions made with reference to the accompanying drawings.

DESCRIPTION OF THE PREFERRED EMBODIMENTS

Figure 1:
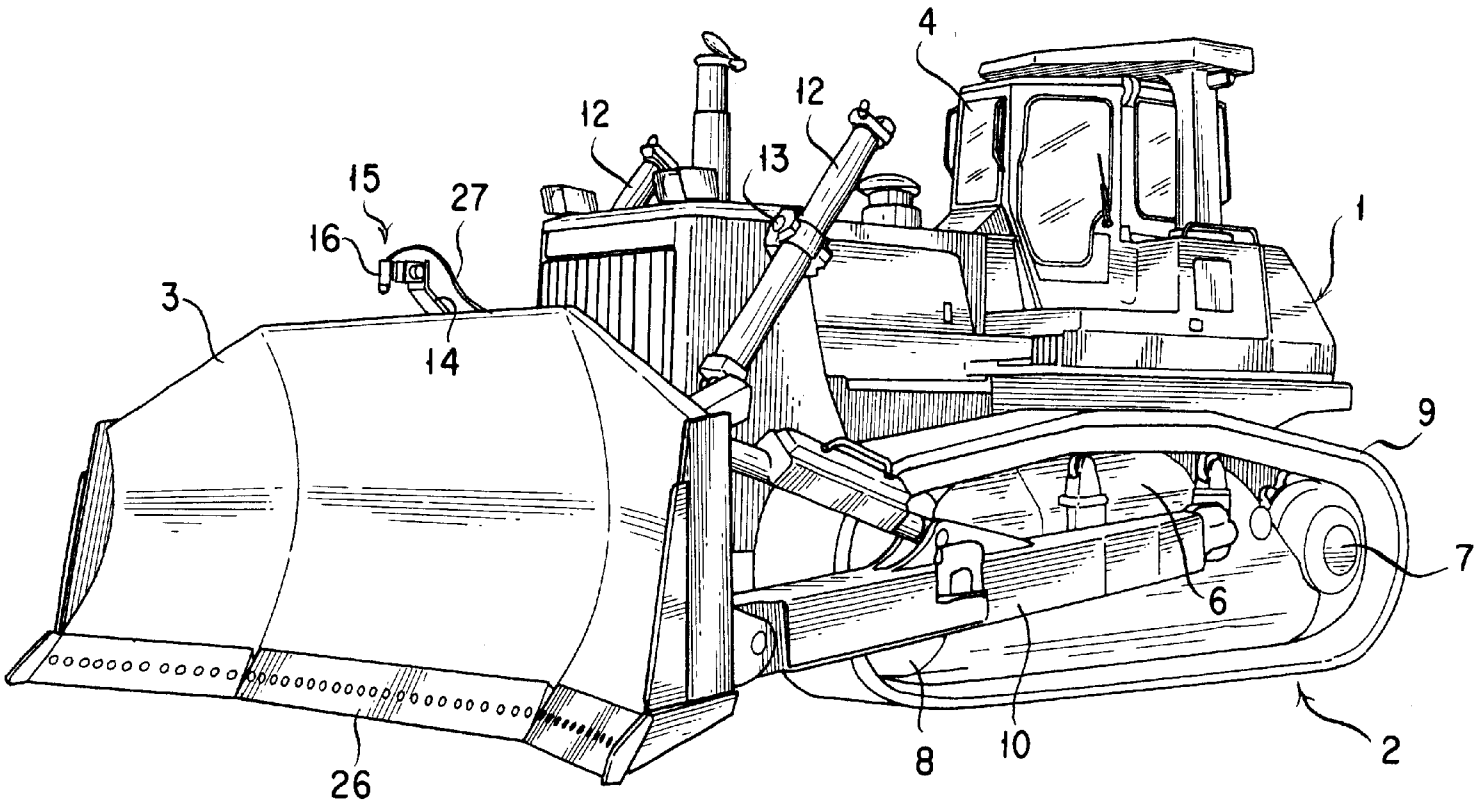
FIG. 1 is a perspective view showing a vehicle provided with a monitoring apparatus for monitoring a forward side portion of a blade of the vehicle, i.e. forward monitoring apparatus referred to hereinlater, according to one embodiment of the present invention.

One preferred embodiment of the present invention will be first described hereunder with reference to FIG. 1.

FIG. 1 is a perspective view showing a vehicle provided with a monitoring apparatus for monitoring a forward side portion of a blade of the vehicle, i.e. forward monitoring apparatus referred to hereinlater, and the vehicle is constructed by a vehicle body 1, lateral traveling members 2, a blade 3 and so on.

The vehicle body 1 is equipped with an operation room or chamber 4 in which an operator seat is disposed. Each of the traveling members 2 is composed of a truck frame 6, a sprocket 7 and an idler 8 both being mounted to the truck frame 6, and a crawler 9 wound around the sprocket 7 and the idler 8.

A frame member 10 extending in a forward direction is coupled, at its rear end portion, to each of the track frames 6 to be vertically swingable, and the back side surface of the blade 3 is coupled, at its both lateral side lower end portions, to a pair of such frame members 10 to be swingable through ball joints or the like.

A tilt cylinder is linked to one of the frame members 10 and the back surface of the blade 3 (the tilt cylinder is disposed on the right side of the vehicle body 1 in the illustration of FIG. 1), and the blade 3 is laterally tilted through the expansion/contraction motion of the tilt cylinder.

A pair of lift cylinders 12 are connected between lateral side portions of the vehicle body 1 and the back surface of the blade 3, respectively, and the lift cylinders 12 are coupled to the vehicle body 1 through yokes 13 mounted to the vehicle body 1 to be swingable. When the lift cylinders 12 are expanded and contracted, the blade 3 is moved vertically and, then, the frame members 10 and the lift cylinders 12 are swung. A mounting member 14 is disposed at an upper laterally central portion of the blade 3, and a forward monitoring device (monitor camera such as television camera set) 16 is mounted to the mounting member 14, so as to be directed downward, through a moving mechanism 15.

Figure 2:
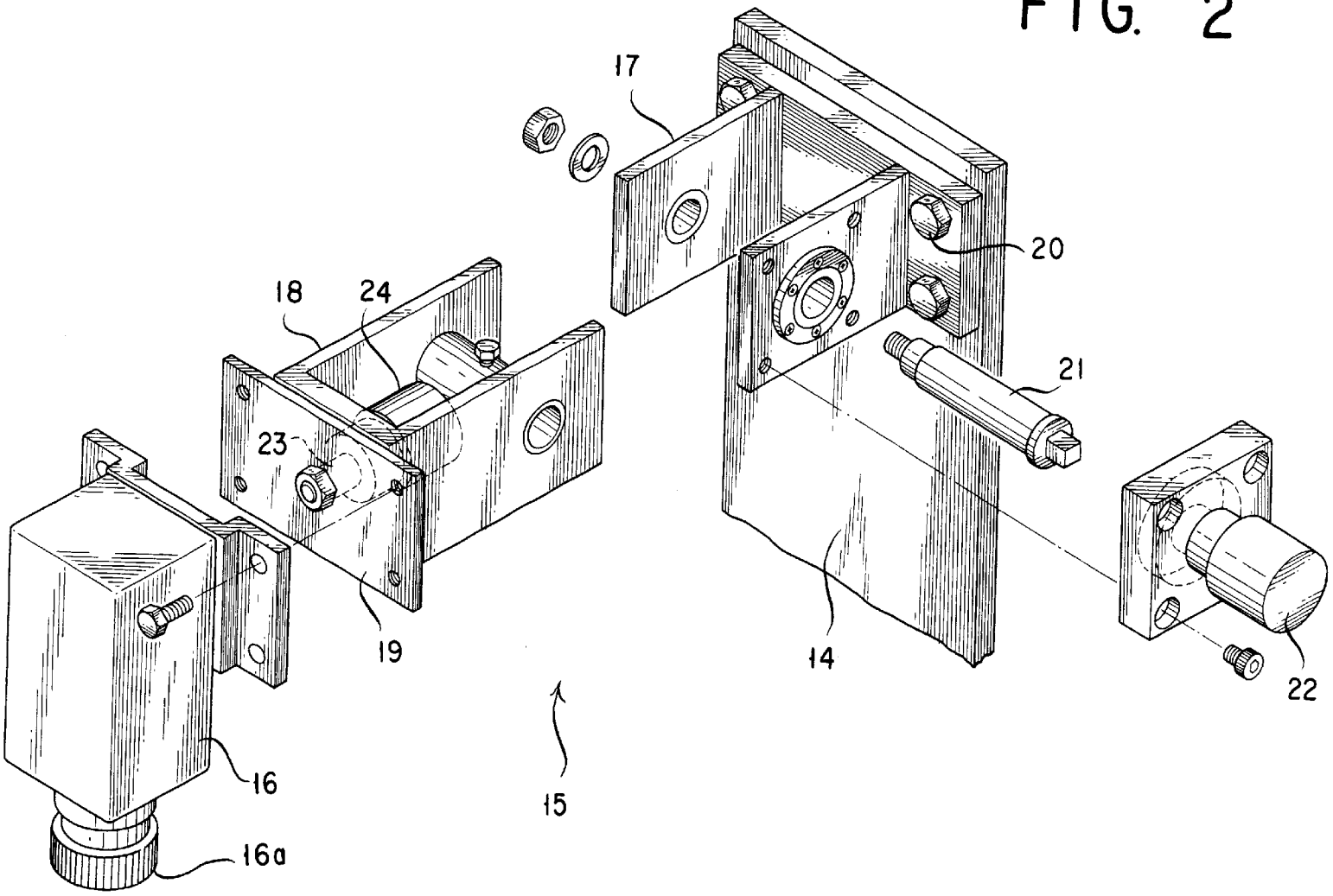
FIG. 2 is a developed perspective view of a movable mechanism of the forward monitoring apparatus of FIG. 1.

As shown in FIG. 2, the moving mechanism 15 is provided with first, second and third brackets 17, 18 and 19.

The first bracket 17 is fastened to the mounting member 14 through fastening means such as bolts 20.

The second bracket 18 is mounted to the first bracket 17 by a first shaft member 21 to be vertically rotatable (pivotal) and the first shaft member 21 is rotated by a first motor 22 mounted to the first bracket 17, thus the second bracket 18 being made to be vertically swingable.

The third bracket 19 is mounted to the second bracket 18 by a second shaft member 23 to be laterally rotatable (pivotal) and the second shaft member 23 is rotated by a second motor 24 mounted to the second bracket 18, thus the third bracket 19 being made to be laterally swingable.

The forward monitoring apparatus (television cameras et) 16 is mounted to the third bracket 19 to be directed downward so that an image pickup member, i.e. lens, 16*a* is directed downward.

Figure 3:
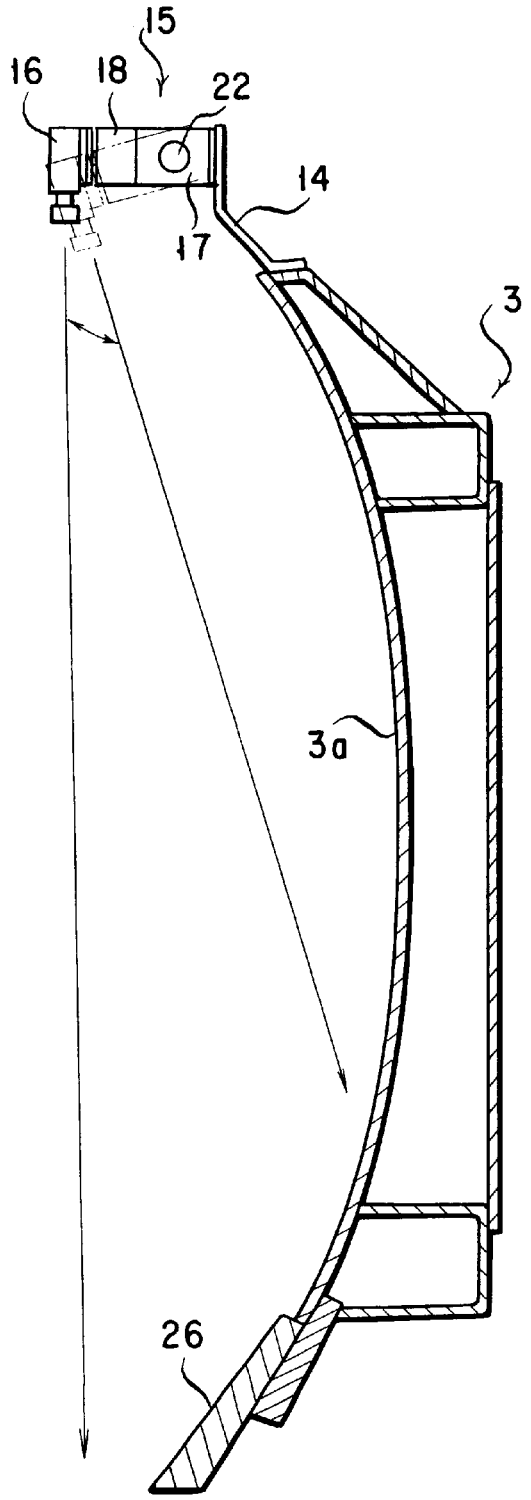
FIG. 3 is a vertical sectional view of the blade to which the forward monitoring apparatus is mounted.

When the first motor 22 is driven, the forward monitoring apparatus 16 is vertically swung as shown by a double headed arrow in FIG. 3 and moved to a position suitable for picking up an image of an optional position in the vertical direction of the front side surface 3*a* of the blade 3.

Figure 4:
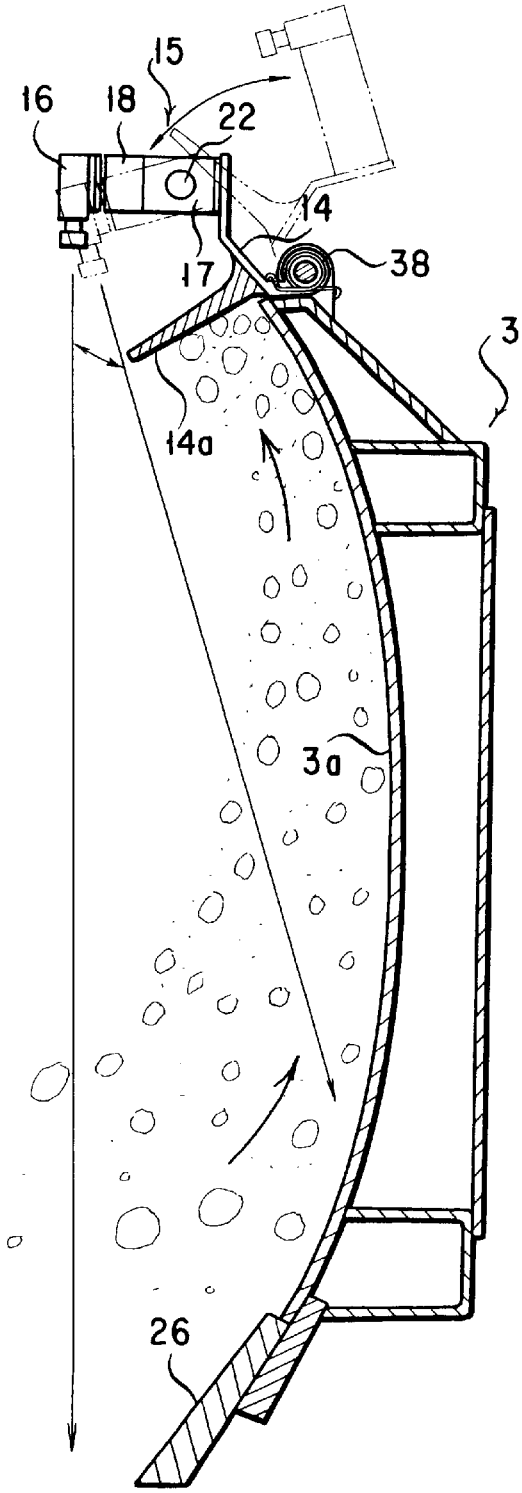
FIG. 4 a vertical sectional view similar to that of FIG. 3, in which a sediment receiving plate is attached to a mounting member through which the forward monitoring apparatus is mounted to the blade.

Further, as shown in FIG. 4, it is, desirable to mount a sediment receiving plate 14*a* to the mounting member 14 for the forward monitoring apparatus 16.

In the structure provided with the sediment receiving plate 14*a*, sediment including soil, small rocks or like scooped up by the blade 3 from the lower side to the upper side thereof abuts or is pushed against the sediment receiving plate 14*a* of the forward monitoring apparatus. The sediment receiving plate 14*a* is thereby pushed upward and, hence, the forward monitoring apparatus is automatically moved rearward of the blade.

The sediment receiving plate 14*a* is urged by a torsion spring, for example, and accordingly, when the pushing force of the scooped-up sediment is released, the sediment receiving plate 14*a* returns to its original position.

Further, upon the movement of the forward monitoring apparatus to the rearward position of the blade 3, a structure is adopted such that a switch of the forward monitoring apparatus is made off.

Figure 5:
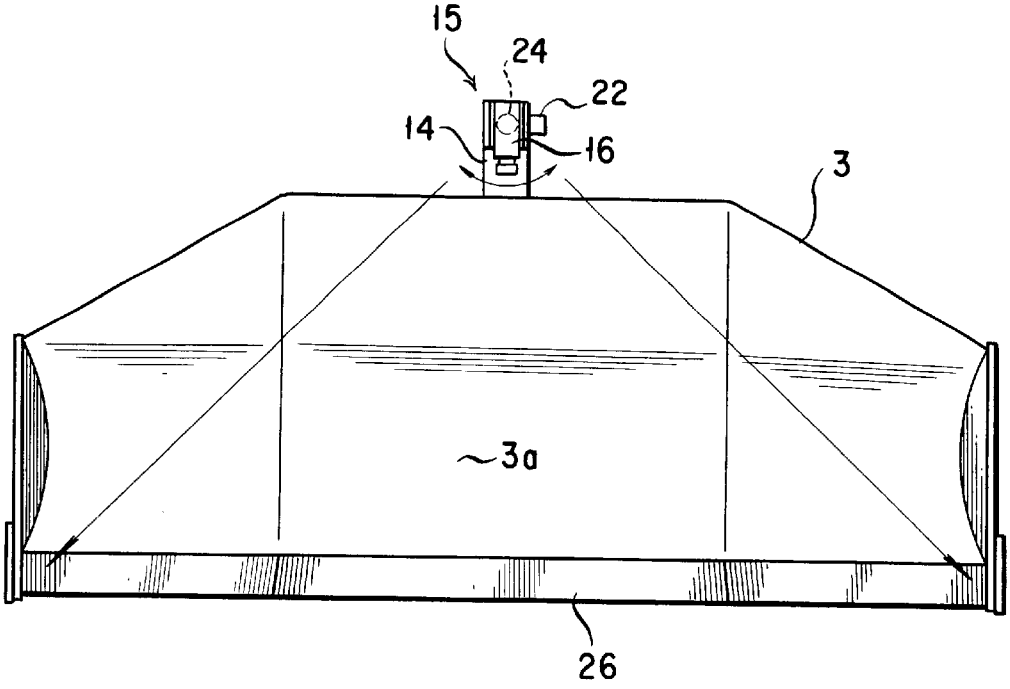
FIG. 5 is a front view of the blade provided with the forward monitoring apparatus of FIG. 3.

Furthermore, as shown in FIG. 5 with a double headed arrow, the forward monitoring apparatus 16 is laterally swung by driving the second motor 24 so as to be moved to a position for picking up an image of a laterally central or positions for picking up images of laterally end portions of the front surface 3*a* of the blade 3.

A display device 25 is set in the o operation room 4 and electrically connected to the forward monitoring apparatus (i.e. television camera set) 16 through wiring 27 or the like to thereby display an image of the front portion of the blade 3 on the display 25 through the television camera set 16.

Figure 6:
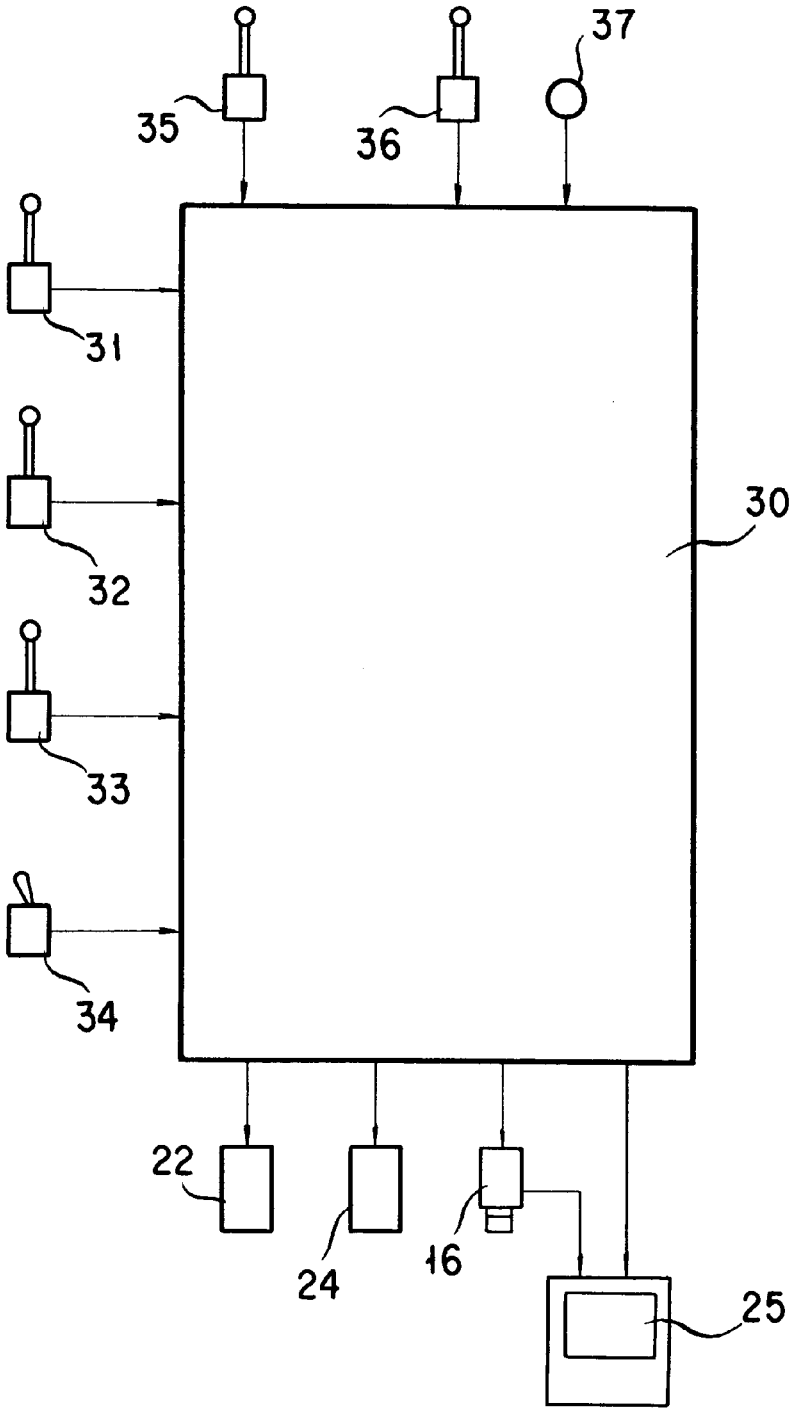
FIG. 6 is an illustration of a block diagram of a control system of the vehicle with which the forward monitoring apparatus is provided.

FIG. 6 is an illustration of a system diagram of a control system including a controller 30 for controlling the of forward monitoring apparatus 16, display device 25, motors 22, 24 and others.

The controller 30 can be operated automatically or manually, and when an operation change-over lever 31 is switched to a manual (hand) operation position, the controller 30 is operated by a manual mode. When a lever 32 for controlling the vertical swing motion is operated, a vertical swing motion signal is inputted into the controller 30, and in response to this signal, the controller 30 drives the first motor 22 to be rotated normally or reversely (i.e. in a reversible manner).

When a lever 33 for the lateral swing motion is operated, a lateral swing signal is inputted into the controller 30, and in response to this signal, the controller 30 operates the second motor 24 in a reversible manner. When a switch 34 is made "ON", a start signal is inputted into the controller 30, which then operates the forward monitoring apparatus (television camera set) 16 and the image display device (display) 25.

The respective levers 31, 32 and 33 and the switch 34 mentioned above are arranged in the operation room 4, and accordingly, the operator in the operation room 4 can visually observe the forward portion of the blade 3 by operating the forward monitoring apparatus 16 and the image display device 25 through the manual operation.

At a time when the operation change-over lever 31 is switched from the manual operation position to the automatic operation position, the controller 30 also takes the automatic operation mode.

Upon an input of an advance signal to the controller 30 from a change gear lever 35 together with a move-down signal from a blade operation lever 36 thereinto, the controller 30 operates the forward monitoring apparatus (television camera set) 16 and the image display device (display) 25.

When the blade 3 is disposed on the ground and starts a forward movement, i.e. excavating and ground leveling working start, the forward monitoring apparatus 16 and the image display device 25 are automatically operated.

Then, when a rearward advancing signal is inputted from the change gear lever 35 and a move-up signal is inputted from the blade operation lever 36 into the controller 30, the controller 30 is operated to stop the operations of the forward monitoring apparatus 16 and the image display device 25.

When the vehicle moves rearward with the blade 3 being detached from the ground, the operations of the forward monitoring apparatus 16 and the image display device 25 automatically stop.

Further, under the state that the move-down signal from the blade operation lever 36 is unputted, when the rearward advancing signal from the change gear lever 35 is inputted, the forward monitoring apparatus 16 and the image display device 25 are operated. Accordingly, in this state, the vehicle is moved rearward with the blade 3 being contacting to the ground, and hence, the ground can be scraped flatly and the forward portion of the blade 3 can be also visually observed by the operator.

This states means that the blade 3 is not tilted in the lateral direction, and hence, the forward monitoring apparatus 16 is positioned to a position suitable for picking up the image of the laterally central portion of the blade 3.

In an occasion where a left tilt signal or right tilt signal is inputted to the controller 30 from the blade operation lever 36, i.e. when the tilt cylinder is contracted so as to tilt the blade 3 in the rightward direction or when the tilt cylinder is expanded so as to tilt the blade 3 in the leftward direction, the controller 30 operates the second motor 24 so as to be normally or reversely rotated to move the forward monitoring apparatus 16 to a position suitable for picking up the image of the left side portion or right side portion of the blade 3.

According to the above operation, when the blade 3 is tilted leftward or rightward to excavate a hard ground (rock bed or the like) by a cutting edge 26 of the left side or right side portion of the blade, the portion to be excavated can be imaged and displayed on the image display device 25.

The vehicle body 1 is also provided with a position detecting means (potentiometer) 37 for detecting a vertical rotation angle of the yoke 13.

The position detecting means (potentiometer) 37 then generates a detection signal which is inputted to the controller 30, and the controller 30 then calculates the excavating position of the cutting edge 26 of the blade 3 in response to this detection signal from the position detecting means (potentiometer) 37, i.e. the vertical swing angle of the lift cylinder 12.

The controller 30 operates to control the normal-to-reverse rotation of the first motor 22 in accordance with the excavating position of the blade 3 calculated as mentioned above to thereby vertically rotate: the forward monitoring apparatus 16 and change the position, in the vertical direction, for picking up the image of the front surface 3*a* of the blade 3 in accordance with the excavating position.

Figure 7A:
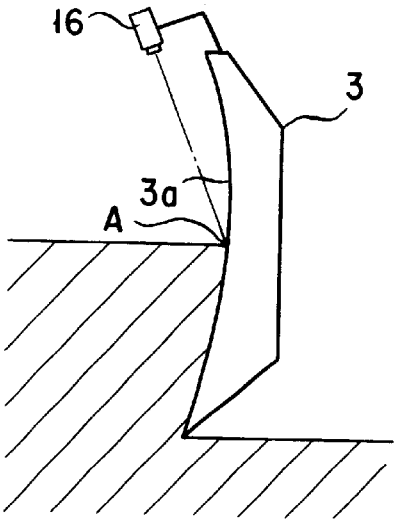
FIGS. 7A and 7B are views showing an excavating condition by the blade of the vehicle.
Figure 7B:
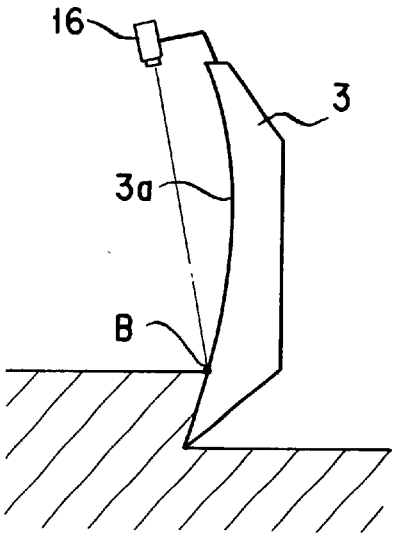

For example, as shown in FIG. 7A, in the case where an excavating position of the blade 3 is deep, the forward monitoring apparatus (television camera set) 16 is moved to a position for picking up an image of an upper side position A of the front surface 3*a* of the blade 3. On the other hand, as shown in FIG. 7B, in the case where an excavating position of the blade 3 is shallow, the forward monitoring apparatus (television camera set) 16 is moved to a position for picking up an image of a lower side position B of the front surface 3*a* of the blade 3.

The vehicle provided with the blade 3, the forward monitoring apparatus 16, the image display device 25 and so on of the structures mentioned hereinbefore will operate as follows.

First, the blade 3 is lowered to the ground by operating the lift cylinders 12, and the bull-dozer is advanced to thereby carry out the dozing working. The sediment is scooped up along the front surface of the blade 3 and the upward movement of the sediment is observed by the operator in the operation room through the image display device, i.e. display 25. Accordingly, since the operator can observe and monitor, in the operation room, the sediment scooped-up state of the blade and the distribution balance thereof in the lateral direction of the blade, the excavating working can be efficiently and safely performed under the monitored control.

In the case of the ground flatly leveling working, the forward monitoring apparatus (television camera set) 16 is directed to the position capable of picking up the image of the substantially laterally central portion of the blade. On the other hand, in the case of the rock bed digging working on the side portion, the forward monitoring apparatus is rotated so as to be directed to the cutting edge of the blade at the corner portion and picking up the image of the actually desired position.

Further, a zoom mechanism may be accommodated in the television camera set, and it may be possible to change the imaging angle of the lens to a standard angle or wide angle.

According to the present invention, as mentioned hereinabove, it is possible for an operator, even a beginner, without depending on an expert technique, to determine a suitable excavating angle and/or depth of the blade in accordance with the quality of the sediment to be excavated.

Furthermore, according to the present invention, since the operator can observe or monitor, in the operation room, the sediment scooped-up state of the blade and the distribution balance of the sediment in the lateral direction of the blade, the sediment excavating and moving workings can be effectively improved. Still furthermore, since the direction of the forward monitoring apparatus, i.e. the television camera set can be optionally changed and the zoom mechanism may be used, the operator can monitor, in the operation room, the desired forward condition or state of the blade, thus ensuring the safe working.

It is to be noted that the present invention is disclosed as preferred embodiments to be applicable to a vehicle provided with an apparatus for monitoring a forward portion of a blade of the vehicle and a method of monitoring the forward portion thereof, but it will easily be noted by those skilled in the art that the present invention is not limited to the described embodiments, and many other changes, modifications and additions may be made without departing from the scopes of the appended claims.

What is claimed is:

1. A vehicle provided with a monitoring apparatus, comprising:

a vehicle body having an operation room;

a forward monitoring apparatus for monitoring a forward portion of a blade provided for the vehicle body;

display means for displaying an image of the forward portion monitored by the forward monitoring apparatus;

a moving mechanism operated in the operation room through a remote control so as to move the monitoring apparatus from a position of the blade to a position for picking up an image of a forward lateral side position and/or a position for picking up an image of a forward vertical position, and the display means on which the picked up image is displayed is disposed in the operation room; and a lift cylinder provided for the vehicle body for moving the blade, position detection means for detecting a position of the blade moved by the lift cylinder and generating a position signal and control means for calculating an excavating position by a cutting edge of the blade in response to the position signal from the position detection means and generating a command signal to the moving mechanism in accordance with a result of the calculation so as to direct the forward monitoring apparatus to a position for picking up the image of the excavating position.

2. A vehicle provided with a monitoring apparatus, comprising:

a vehicle body having an operation room;

a forward monitoring apparatus for monitoring a forward portion of a blade provided for the vehicle body;

display means for displaying an image of the forward portion monitored by the forward monitoring apparatus;

a moving mechanism operated in the operation room through a remote control so as to move the monitoring apparatus from a position of the blade to a position for picking up an image of a forward lateral side position and/or a position for picking up an image of a forward vertical position, and the display means on which the picked up image is displayed is disposed in the operation room; and a lift cylinder provided for the vehicle body for moving the blade, position detection means for detecting a position of the blade moved by the lift cylinder and generating a position signal and control means for calculating an excavating position by a cutting edge of the blade in response to the position signal from the position detection means and generating a command signal to the moving mechanism in accordance with a result of the calculation so as to direct the forward monitoring apparatus to a position for picking up the image of the excavating position;

wherein said monitoring apparatus is a television camera set provided with a zoom mechanism which is operated remotely in the operation room.

* * * * *